United States Patent [19]

Vlnaty

[11] 4,244,528

[45] Jan. 13, 1981

[54] PROCESS FOR MICRONIZING OF SOLID CARBONACEOUS MATTER AND PREPARATION OF CARBON-OIL MIXTURES

[75] Inventor: Joseph Vlnaty, Pittsburgh, Pa.

[73] Assignee: Dravo Corporation, Pittsburgh, Pa.

[21] Appl. No.: 61,030

[22] Filed: Jul. 26, 1979

[51] Int. Cl.[3] ..... B02C 19/06

[52] U.S. Cl. ..... 241/5; 241/19; 241/29; 241/39; 241/40

[58] Field of Search ..... 241/5, 14, 19, 24, 29, 241/40, 39, 43, 61, 79.1, 80, 152 A, 152 R

[56] References Cited

U.S. PATENT DOCUMENTS

| | | | |
|---|---|---|---|
| 251,803 | 1/1882 | Starkey | 241/40 X |
| 2,908,634 | 10/1959 | Stratford | 241/5 X |
| 3,539,294 | 11/1970 | Hwang | 241/5 X |

*Primary Examiner*—Mark Rosenbaum

*Attorney, Agent, or Firm*—Parmelee, Miller, Welsh & Kratz

[57] ABSTRACT

A process and apparatus for micronizing solid carbonaceous material and preparing carbon oil mixtures. Micronization is accomplished by projecting particles of a carbonaceous material into the point where a number of fluid streams intersect and by then impacting the particles against a rotating cone. The resulting micronized particles are then separated from the fluid in which they are entrained and are mixed with fuel oil. A preferred fluid for use in this process is a gaseous mixture consisting of about fifty percent steam and fifty percent flue gas.

30 Claims, 1 Drawing Figure

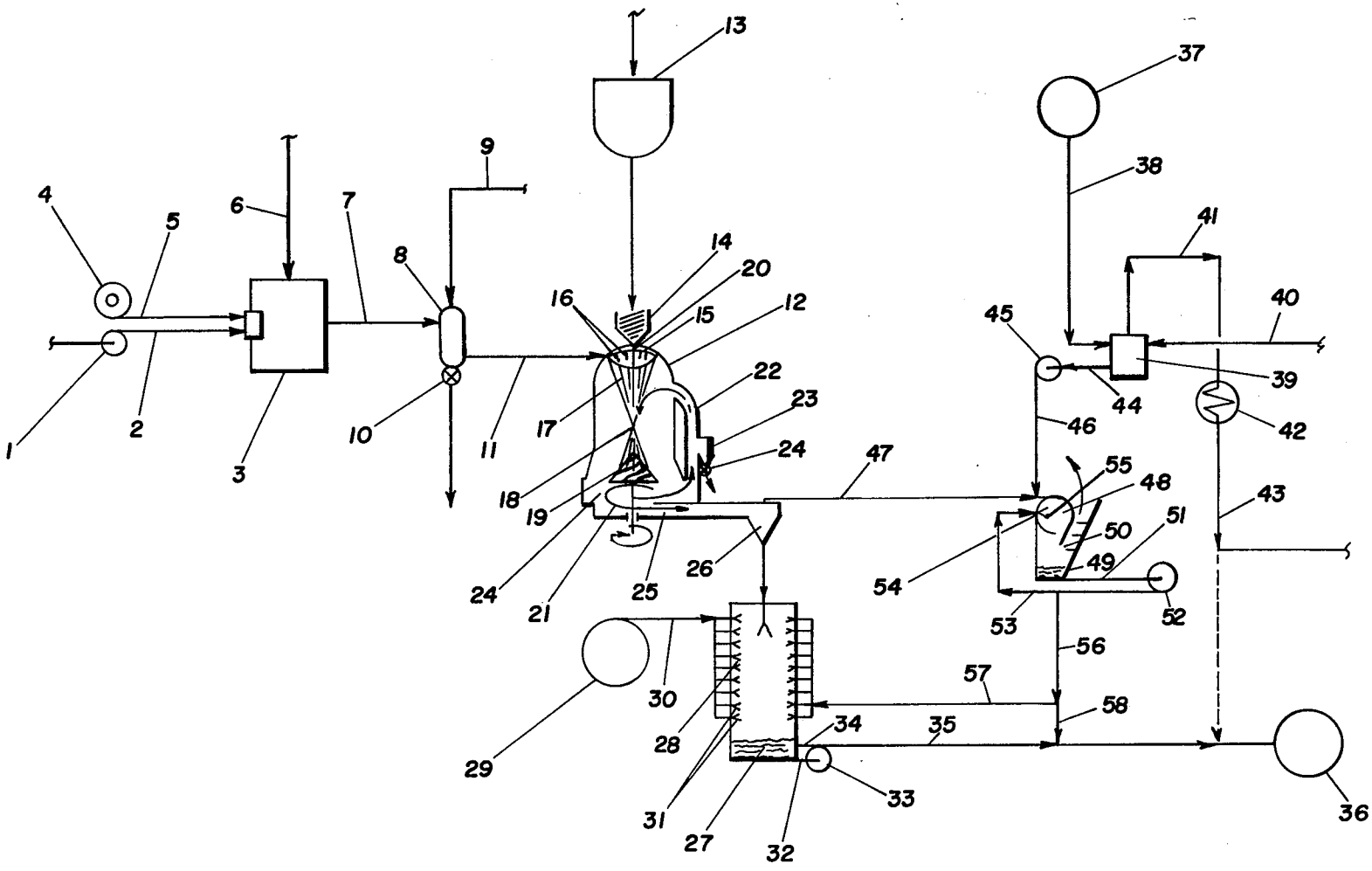
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58

PROCESS FOR MICRONIZING OF SOLID CARBONACEOUS MATTER AND PREPARATION OF CARBON-OIL MIXTURES

BACKGROUND OF THE INVENTION

The present invention relates to mixtures of solid materials and fuel oil and, in particular, to a process and apparatus used in preparing mixtures of fuel oil and micronized solid carbonaceous materials.

It has been suggested that, for boiler use and certain other purposes, currently limited supplies of fuel oil might be appreciably extended by mixing such fuel oil with more abundant solid carbonaceous fuels such as coal, coke, petroleum coke, graphite, or charcoal. While such mixing can significantly increase the heat value of a given amount of fuel oil, it has been found that, in order to produce a physically stable carbon-oil mixture having a suitable degree of reactivity, the solid carbonaceous material must be reduced to micron or submicron size before mixing takes place. As might be expected, the reduction of the solid carbon to such a small size, especially in the amounts which would be necessary for the large scale production of carbon-oil mixtures, is an expensive and cumbersome procedure. These high costs are attributable not only to the sizeable initial investment required for the necessary transport and pulverizing equipment, but also to the rapid wearing of that equipment and to the occurrence of certain adverse environmental effects which accompany the employment of the carbon-oil mixture production processes currently in use. For example, reduction of coal and other solid carbonaceous materials for the purpose of producing carbon-oil mixtures is commonly accomplished in fluid mills in which expensive, high quality steam is employed. Such mills experience rapid erosion by the jet streams. Furthermore, the steam effluent leaving the process carries superfine carbon particles, thus necessitating the installation of additional expensive equipment for the purpose of removing these particles from the steam.

U.S. Pat. No. 2,612,320 discloses a pulverizer in which particles are impacted against one another by means of a plurality of fluid streams. This pulverizer requires that pulverized particles be removed from an enclosed impact area by suction, and while certain features are disclosed which tend to limit undesirable accumulations of particles in the impact area, the fact that such accumulations are still possible and that relatively elaborate apparatus is necessary to effect their removal must be considered a disadvantage of this design. Furthermore, where pulverization occurs as a result of collisions between particles in intersecting fluid streams, there exists a probability that a certain number of particles will escape such collisions. Consequently, since there is no second grinding stage in the apparatus disclosed in U.S. Pat. No. 2,612,320, that design may require an undesirably high percentage of particles to be recycled for further pulverization.

U.S. Pat. No. 251,803, on the other hand, discloses an impact pulverizer in which all particles to be pulverized are entrained in a fluid stream and then impacted against a rotating, conically shaped concussion plate. The rotating concussion plate not only pulverizes the particles but also imparts lateral motion to them so as to continuously remove pulverized particles from the impact area. While this design avoids some of the above-mentioned disadvantages attending the design disclosed in U.S. Pat. No. 2,612,320, it is possible that rapid wearing of the grinding surface of the concussion plate will occur since most, if not all, required pulverization occurs on that surface. The lack of any appreciable action which might serve to augment the pulverizing occuring on the grinding surface may be attributable to the small probability that a significant number of destructive collisions will occur between unreduced particles in the fluid stream before they have impacted against that grinding surface.

Consequently, it is found that, notwithstanding the great potential for conserving scarce supplies of fuel oil which the widespread use of carbon-oil mixture might have, such widespread acceptance of this fuel has not been achieved, in large part due to the aforementioned difficulties associated with its production. It is, therefore, an object of the present invention to provide a process and apparatus for the production of carbon-oil mixtures by which these difficulties are substantially overcome.

SUMMARY OF THE INVENTION

According to the present invention a number of fluid streams are directed so that the streams intersect at a common collision point, from which point the streams diverge until they impinge on the grinding surface of a rotating, conically shaped concussion plate. Solid carbon particles may then be micronized for subsequent mixing with fuel oil by introducing the particles into the collision point of the fluid streams so that the carbon particles undergo catastrophic destruction, are entrained to the fluid streams, and are projected against the grinding surface of the rotating concussion plate. The rotating concussion plate serves to further reduce the particles and also changes their direction of movement so that they are continuously removed for subsequent mixing with oil in an outlet line.

In a preferred embodiment of this invention means are provided for classifying the particles according to size before they enter the outlet lines and for recycling particles larger than a certain size and for recycling such particles for further reduction. In another preferred embodiment of this invention, the fluid used to effect micronization is a high temperature, high pressure inert gaseous mixture made up of about 50% steam and 50% flue gas. In still another preferred embodiment of this invention, this gaseous mixture is treated, after it is used for pulverization, first in a cyclone separator and then with an oil spray, so as to remove all residual carbon particles from it before it is vented into the atmosphere.

BRIEF DESCRIPTION OF THE DRAWING

The drawing is a schematic drawing of a carbon-oil separation plant embodying the principles of the present invention.

DESCRIPTION OF THE PREFERRED EMBODIMENT

In the present invention the grinding fluid may be produced by stoichiometric combustion of a hydrocarbon fuel which is pumped by fuel pump 1 through line 2 into pressurized combustor 3. Air to support such combustion is provided by means of air compressor 4 through line 5 into combustor 3. The temperature of the combustor 3 may be controlled through evaporative cooling by vaporizing water which is injected into combustor 3 through water line 6. The atmosphere inside combustor 3 is, consequently, made up of a gaseous mixture of combustion products and steam. It is preferred that sufficient water be injected into combustor 3 so that said gaseous mixture is saturated with steam. This gaseous mixture passes from the combustor 3 through line 7 into a cooling and cleaning high pressure chamber 8. The temperature of the gaseous mixture leaving the combustor 3 is preferably at a temperature of about 2000° F. Water is injected into the final cooling and cleaning chamber 8 through water line 9 so as to adjust the pressure and temperature of the gaseous mixture in that chamber. It is preferred that the gaseous mixture in chamber 8 be adjusted to a temperature of 600°-800° F. The composition of the gaseous mixture at this point is also preferably adjusted so that it is 50% steam and 50% flue gas. Chamber 8 is also equipped with a discharge 10 through which soot and ash are periodically removed.

The gaseous mixture exhausted from chamber 8 is conveyed through line 11 to fluid mill 12. Positioned above fluid mill 12 is coal bin 13. Preground $\frac{1}{8}''$ −200 mesh coal is introduced from the coal bin 13 through feeder 14 into the fluid mill 12. Inside the fluid mill 12, line 11 connects with circular line 15. There are a plurality of high pressure nozzles positioned on circular line 15 arranged and directed so that a plurality of fluid streams 17 are formed. The fluid streams 17 first converge, then intersect at a common collision point 18, and then diverge and impact on the upper grinding surface of a conically shaped concussion plate 19. The concussion plate 19 is equipped with a means to cause its rotation about the axis passing through its vertex, and it is noted that it is not essential that it be conical in shape. It may be of any other shape, such as pyramidal, in which its upper grinding surface is raised or convex.

From the feeder 14 there is a stream 20 of coal particles which intersects with fluid streams 17 at collision point 18 where these coal particles undergo catastrophic destruction and are fluidized in streams 17 so that they are conveyed to and impacted against the grinding surface of the rotating concussion plate 19 where they undergo further reduction. The rotation of concussion plate 19 also causes the fluid in fluid streams 17 to assume an angular motion. The particles are, therefore, continuously cleared from the grinding surface of the rotating concussion plate 19 and are removed by the redirected fluid streams to the classification section 21. The larger particles, or those which are preferably greater than one micron, are carried laterally by the redirected fluids to a recycle lift pipe 22, through which they rise to the top of the mill and are reintroduced into stream 17 and are reconveyed to the collision point 18 where they undergo further grinding. The lift pipe 22 is equipped with an electromagnet 23 which produces a pulsating magnetic field and which causes magnetic pyrites which are mixed with the larger particles to be collected in collection chamber 24, from where they are periodically discharged.

The smaller, micronized particles, on the other hand, are swept by the redirected fluids from classification section 21 into outlet line 25, and through said line into cyclone separator 26. In cyclone separator 26 the particles are separated from the fluids in which they are entrained, and the separated particles are then introduced into mixing chamber 27. Mixing chamber 27 has on its walls a plurality of nozzles 28 which are connected to oil tank 29 by line 30 such that multiple oil sprays 31 are produced inside mixing chamber 27. A stream of micronized coal from the cyclone separator 26 is passed through mixing chamber 27, where it is first contacted with the oil sprays and is then collected as a coal-oil mixture on the bottom of mixing chamber 27. The coal-oil mixture at the bottom of mixing chamber 27 is removed through line 32 by recycle pump 33. Part of the coal-oil mixture removed from the mixing chamber 27 in line 32 is returned to the mixing chamber 27 through line 34 so as to further homogenize the mixture. The remainder is conveyed through line 35 to storage tank 36.

Makeup oil is also provided to the system from a second oil tank 37 from where it flows by way of line 38 to stabilizer 39. Steam is provided to stabilizer 39 by steam line 40. This steam comes into direct contact with the oil in stabilizer 39 and heats the oil so as to cause volatile hydrocarbons to be removed through line 41 to condenser 42, from where condensate may be added by way of line 43 to the coal-oil mixture in line 35. Stabilized makeup oil collected in stabilizer 39 is removed therefrom by means of line 44 pump 45 and line 46. Gas having superfine coal particles entrained with it is simultaneously removed from the cyclone separator 26 by means of line 47 to cyclone 48. Before, however, the gas-coal stream in line 47 enters cyclone 48, it is mixed with the stabilized makeup oil from line 46, with the result that the coal particles entrained in the gas stream in line 47 are collected in the oil. This coal-oil mixture, as well as the remaining gas, pass through cyclone 48 to gas separator 49, from where the gas escapes through vent 50, and at the bottom of which the coal-oil mixture is collected. The coal-oil mixture is removed from the gas separator 49 by line 51 to pump 52 from where it is conveyed through line 53 to nozzle 54 on the cyclone 48. Nozzle 54 forms oil spray 55 inside cyclone 48 so as to remove any residual fine coal dust from the gas therein. Part of the coal mixture in line 53 is also removed through line 56 and line 57 and is added to the oil introduced to the mixing chamber 27 through nozzles 28. Additionally, part of the coal-oil mixture in line 53 is also removed through line 56 and line 58 and is added to the coal-oil mixture in line 35.

I claim:

1. In a process for pulverizing particles of a solid material wherein said particles are projected against a concussion plate while said concussion plate rotates about its axis passing through its vertex the improvement comprising the steps of:

(a) directing at least two intersecting fluid streams so that said streams first intersect at a common collision point and then diverge until they impinge on the convex grinding surface of a concussion plate having a centrally disposed vertex;

(b) projecting the particles to be pulverized into said collision point whereby reduction is effected and said reduced particles are fluidized in said fluid streams; and (c) allowing said particles within the fluid stream to impact against the grinding surface of the rotating concusion plate such that they are further reduced and continuously cleared from said grinding surface.

2. The process of claim 1 wherein the solid material is a carbonaceous material.

3. The process of claim 1 wherein the rotating concussion plate forms an angularly directed fluid stream which continuously removes particles to a remote position after said particles have been cleared from the grinding surface of said concussion plate.

4. The process of claim 1 wherein after step (c) there are added the further steps of:

(d) separating the particles cleared from the grinding surface of the concussion plate by size into a larger class of particles and a smaller class of particles;

(e) returning the larger class of particles to the collision point so that they undergo further reduction; and (f) removing the smaller class of particles to a collection point remote from the concussion plate.

5. The process of claim 4 wherein the larger class of particles pass through a magnetic field before they are returned to the collision point so as to remove ferromagnetic materials therefrom.

6. In a process for forming a carbon-oil mixture wherein a concussion plate rotates about the axis passing through its vertex and causes a fluid impinging on its surface to flow in a redirected fluid stream the improvement comprising the steps of:

(a) causing a fluid to flow in at least two intersecting fluid streams, directed so that said streams first intersect at a common collision point and then diverge until they impinge on the convex grinding surface concussion plate having a centrally disposed vertex;

(b) projecting particles of a carbonaceous material into said collision point whereby reduction is effected and said reduced particles are fluidized in said intersecting fluid streams;

(c) allowing the reduced particles within the intersecting fluid stream to impact against the grinding surface of the rotating concussion plate such that they are further reduced, are continuously cleared from said grinding surface, and are fluidized in the redirected fluid stream;

(d) allowing the redirected fluid stream to remove the particles from the concussion plate;

(e) separating the particles from the redirected fluid stream; and (f) mixing the particles with oil.

7. The process of claim 1 or 6 wherein the fluid making up the fluid streams is an inert gas.

8. The process of claim 1 or 6 wherein the fluid streams are made up of a gaseous mixture consisting of about 50% steam and about 50% flue gas.

9. The process of claim 8 wherein the flue gas consists of gaseous combustion products resulting from the stoichiometric combustion of a hydrocarbon fuel.

10. The process of claim 8 wherein the gaseous mixture is initially at a temperature of from about 600°–800° F. and at a pressure of from about 200–300 psi.

11. The process of claim 1 or 6 wherein the concussion plate is conically shaped.

12. The process of claim 1 or 6 wherein the concussion plate is pyramidally shaped.

13. The process of claim 1 or 6 wherein the intersecting fluid streams are directed downwardly and inwardly from a plurality of circularly arranged nozzles such that the fluid streams intersect at a common collision point and then flow downwardly and outwardly until said fluid streams impinge on the grinding surface of the concussion plate.

14. The process of claim 13 wherein the particles are projected into the collision point of the intersecting fluid streams of gravity.

15. The process of claim 2 or 6 wherein the carbonaceous material is coal.

16. The process of claim 6 wherein between steps (e) and (f) there are added the further steps of:

(g) classifying the particles into larger particles and smaller particles; and (h) recycling said larger particles to the collision so that they undergo further reduction.

17. The process of claim 16 wherein the larger particles are particles of a size greater than one micron.

18. The process of claim 6 wherein the fluid separated from the particles in step (e) is then mixed with stabilized makeup oil so as to remove residual particles therefrom.

19. The process of claim 6 wherein the particles are mixed with oil by dropping said particles through a plurality of oil sprays.

20. A fluid mill for pulverizing particles of a solid material having a concussion plate with a base side and a grinding surface with a centrally disposed vertex, a means for rotating said concussion plate about its axis passing through the vertex of its grinding surface, a plurality of nozzles disposed in a circular arrangement and in a spaced relation to said grinding surface, and a housing enclosing the concussion plate and said nozzles, said housing having a particle outlet opening adjacent said concussion plate wherein the improvement comprises:

(a) said concussion plate has a convex grinding surface;

(b) said nozzles are directed such that fluid passing therethrough forms streams which first intersect at a common collision point and then diverge until said streams impinge on the grinding surface of the concussion plate; and (c) a particle feed means extending through said housing whereby particles to be pulverized may be projected into the collision point from where they are first propelled against the grinding surface of the concussion plate and then evacuated through the particle outlet openings in a reduced form.

21. The fluid mill of claim 20 wherein the nozzles are disposed above the concussion plate and the feed means is centrally positioned in relation to said fluid jets so that particles to be pulverized may be projected by gravity into said collision point.

22. The fluid mill of claim 21 wherein a particle separating means is disposed between the concussion plate and the particle outlet opening so as to permit the recycle of larger particles.

23. The fluid mill of claim 22 wherein the housing has a laterally attached riser pipe having an opening adjacent to the separating means and another opening adjacent the nozzles so that said larger particles may be recycled to the collision point for further reduction.

24. The fluid mill of claim 23 wherein the riser pipe is equipped with an electromagnet so as to remove magnetic materials from said larger particles.

25. The fluid mill of claim 20 wherein the particle outlet opening is connected by means of an outlet line to a particle and fluid separating means.

26. The fluid mill of claim 25 wherein the particle and fluid separating means is a cyclone separator.

27. The fluid mill of claim 25 wherein the particle and fluid separating means is connected by means of a fluid conveying line to a fluid and oil mixing means, wherein residual particles carried by fluid are removed.

28. The fluid mill of claim 25 wherein the particle and fluid separating means is connected to a particle and oil mixing means, wherein a particle-in-oil mixture is formed.

29. The fluid mill of claim 20 wherein the grinding surface of the concussion plate is conically shaped.

30. The fluid mill of claim 20 wherein the grinding surface of the concussion plate is pyramidally shaped.

* * * * *